US005358000A

United States Patent [19]

O'Hair

[11] Patent Number: 5,358,000

[45] Date of Patent: Oct. 25, 1994

[54] SIPHON PUMP HAVING A METERING CHAMBER

[76] Inventor: Michael T. O'Hair, HC #82, Box 145, Betsy Ridge Rd., Ravenna, Ky. 40472

[21] Appl. No.: 107,124

[22] Filed: Aug. 17, 1993

[51] Int. Cl.[5] ..... F04F 10/00

[52] U.S. Cl. ..... 137/124; 137/142; 137/143; 137/130; 137/132; 137/403

[58] Field of Search ..... 137/142, 413, 130, 140, 137/132, 403, 404, 406, 129, 124

[56] References Cited

U.S. PATENT DOCUMENTS

| | | | |
|---|---|---|---|
| 136,809 | 3/1873 | Bois | 137/136 |
| 210,965 | 12/1878 | Rhoads | 137/136 |
| 336,327 | 2/1886 | Laska . | |
| 375,948 | 1/1888 | Pocknell | 137/406 X |
| 462,654 | 11/1981 | Damron | 137/142 |
| 1,208,513 | 12/1916 | Derry . | |
| 1,564,430 | 12/1925 | Maddrell . | |
| 1,635,477 | 7/1927 | Hall . | |
| 2,142,556 | 1/1939 | Carr . | |
| 2,363,539 | 11/1944 | Loughridge | 137/142 X |
| 2,376,623 | 5/1945 | Romberg . | |
| 3,499,585 | 3/1970 | Halff et al. . | |
| 3,575,004 | 4/1971 | Gachne . | |
| 3,888,276 | 6/1975 | Wannan | 137/404 X |
| 4,095,615 | 6/1978 | Ramsauer | 137/140 X |
| 4,168,717 | 9/1979 | Rinker . | |
| 4,406,300 | 9/1983 | Wilson . | |
| 4,770,345 | 9/1988 | Ross, Jr et al. | 137/403 X |

FOREIGN PATENT DOCUMENTS

| | | |
|---|---|---|
| 1051730 | 1/1954 | France . |
| 696095 | 11/1979 | U.S.S.R. . |

*Primary Examiner*—Martin P. Schwadron
*Assistant Examiner*—Kevin L. Lee
*Attorney, Agent, or Firm*—Nies, Kurz, Bergert & Tamburro

[57] ABSTRACT

A siphon pump system for pumping water from a water source to a supply destination. The system includes a holding canister through which the water flows, and a first timing bucket associated with the holding canister for controlling the admission of air into the system to thereby permit flow of water contained within the holding canister. A lower flow control chamber is provided adjacent the outlet from a long, second siphon conduit extending from the holding canister to control the refilling of the holding canister in an automatic manner and without the need for connections with a source of electrical power.

13 Claims, 4 Drawing Sheets

SIPHON PUMP HAVING A METERING CHAMBER

BACKGROUND OF THE INVENTION

1. Field of the Invention

The present invention relates to improved water supply systems including siphon pumps for transferring water in a controlled manner from a reservoir at a first elevation to a second, higher, elevation, and then to a third elevation lower than the first elevation without the need for electrically-operated pumps. More particularly, the present invention relates to a water supply system based upon a siphon pump and including a holding container that has a predetermined capacity to define a predetermined volume of water to be dispensed.

2. Description of the Related Art

Siphon pumps are well known and have been in use for a long period of time. An early example of a siphon pump water supply system is disclosed in U.S. Pat. No. 136,809, which issued on Mar. 18, 1873, to J. M. Bois. The system therein disclosed includes a spring-controlled automatic valve at an outlet leg of the siphon to prevent outflow of water when the automatic valve is closed. The result of the operation of the device therein disclosed is to provide a pulsating flow of water at the outlet, because the spring forming part of the automatic valve is alternately compressed and expanded to open and close the automatic valve. Another form of siphon pump system for providing a supply of water from a reservoir without the need for electrically-powered pumps is disclosed in U.S. Pat. No. 336,327, which issued Feb. 16, 1886, to M. A. Laska. However, the Laska system contemplates several cisterns that are adapted to contain water at a level equal to the level in the water source. Accordingly, the Laska system has limited utility in hilly areas.

It is an object of the present invention to overcome the shortcomings of the prior art siphon pump systems.

SUMMARY OF THE INVENTION

Briefly stated, in accordance with one aspect of the present invention, a siphon pump is provided for dispensing from a water supply source a predetermined quantity of the water. The system includes a holding canister that includes an outlet valve for controlling the flow of water from the holding canister into a destination container positioned below the holding canister. A first siphon conduit extends from the water supply source to the filter canister and includes an inlet that extends within the water supply source and an outlet that is at an elevation above that of the water supply source. A second siphon conduit extends from the holding canister to an outlet an elevation below the first siphon conduit inlet, the second siphon conduit having a longer length than that of the first siphon conduit.

A system flow control valve is positioned in the second siphon conduit for controlling the flow of water through the second siphon conduit, and an anti-backflow valve is positioned within and adjacent to the outlet of the second siphon conduit.

A destination container is positioned below the holding canister for receiving water that flows from the holding canister, and a flow control valve at a water outlet from the holding canister is provided for controlling the flow of water into the destination container. The holding canister includes a charging inlet conduit at an upper end of the holding canister for admitting air into the holding canister and for permitting water from exiting from the holding canister.

DESCRIPTION OF THE PREFERRED EMBODIMENTS

Figure 1:
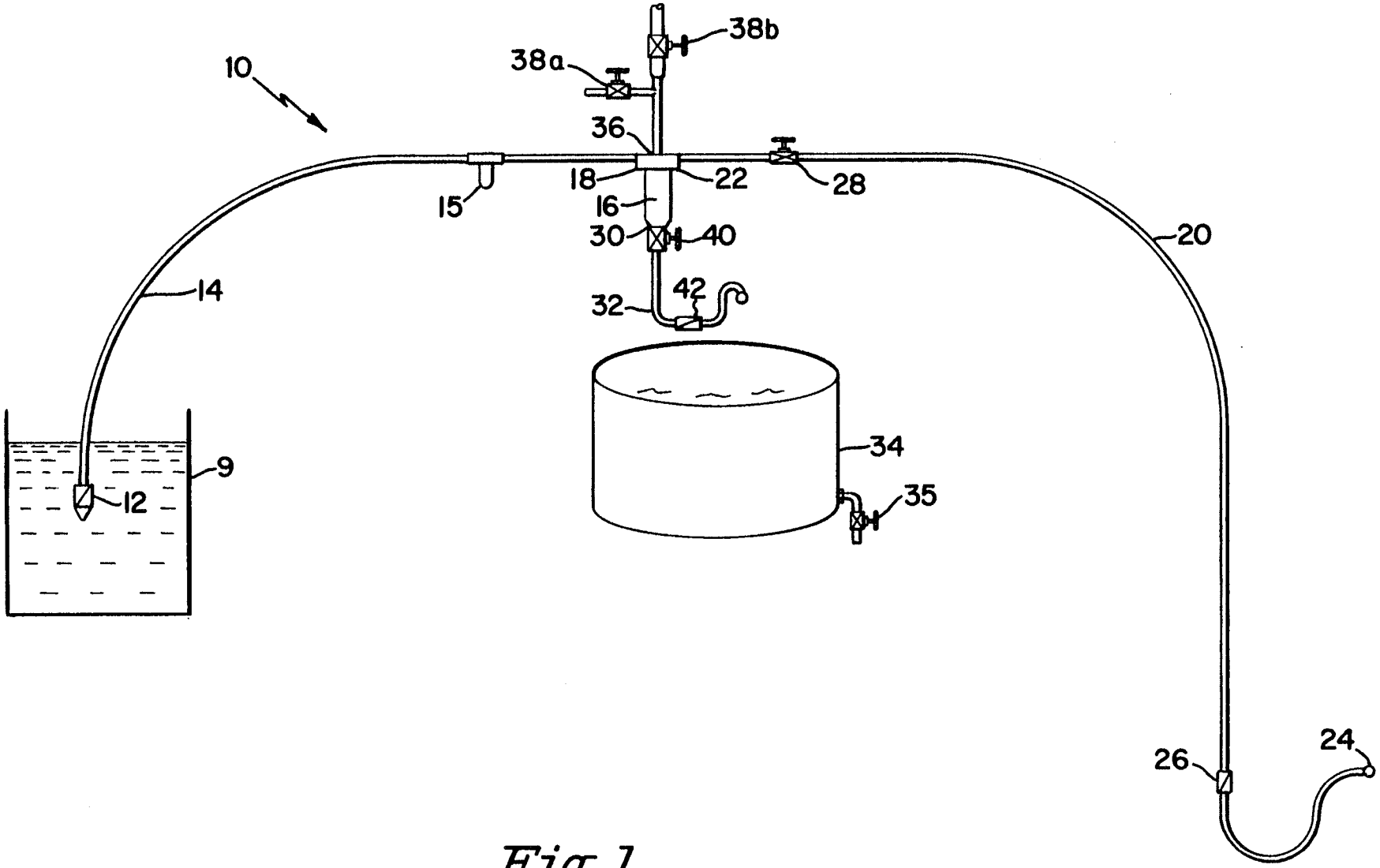
FIG. 1 is a schematic view of a siphon-pump-based water distribution system in accordance with the present invention.

Referring now to the drawings, and particularly to FIG. 1 thereof, there is shown a water distribution system 10 for transferring water from a water supply source 9, through a foot valve 12 to a discharge point that can be at a higher elevation than that of the water source. System 10 includes a first siphon conduit 14 that extends from the water source, via a foot or anti-backflow valve 12, to a filter canister 15 and then to a larger, holding canister 16 positioned at a higher elevation than that of the water source. First siphon conduit 14 includes an inlet that is adjacent foot valve 12 and that is submerged within the water source, and it extends to and connects with a first inlet 18 of holding canister 16.

A second siphon conduit 20 extends from a first outlet 22 of holding canister 16 to a system flow outlet 24 that is positioned at an elevation well below the elevation of the water source. Additionally, second siphon conduit 20 preferably has a length that is substantially longer than that of first siphon conduit 14, and it includes an anti-backflow valve 26, which can be a check valve, adjacent flow outlet 24 to prevent reverse flow through second siphon conduit 20 in a direction from outlet 24 toward canister 16. A system flow control valve 28 for turning the system on and off is positioned in second siphon conduit 20 and is preferably located close to holding canister 16 for convenience of access.

Holding canister 16 can be of any convenient size, and in a preferred embodiment of the invention it has a water capacity of about one gallon. Additionally, a filter canister 15 is preferably provided upstream from holding canister 16 for filtering particulate matter from the water before the water passes into holding canister 16 to second outlet 30, through outlet conduit 32, and into a destination container 34 that includes an outlet spigot 35.

Holding canister 16 also includes a second inlet 36 that extends vertically upwardly therefrom to define a charging inlet that includes a water charging valve **38*a* for initial charging or priming of the system with water, as will hereinafter be explained, and an air inlet valve 38*b***.

Outlet conduit 32 extending from second outlet 30 of canister 16 includes an outlet flow control valve 40, and it includes an anti-backflow valve 42, such as a check valve, to prevent reverse flow within outlet conduit 32, the need for which is dependent upon the configuration and orientation of conduit 32.

In operation, the system is primed by opening system charging valve 38 above holding canister 16 and then closing flow control valve 40. During priming, both system flow control valve 28 and outlet valve 40 are in the off position. Water is introduced into the system through the water charging valve 38*a* until the system can accept no additional water, after which outlet valve 40 is opened to allow air to escape. After water runs continuously from outlet conduit 32 into destination container 34, which indicates that the air has been sufficiently purged from the inlet portion of the system, outlet flow control valve 40 is closed and system flow control valve 28 is opened so that water enters second siphon conduit 20 to fill it by displacing the air through flow outlet 24. After the water runs continuously from flow outlet 24, water charging valve 38*a* is closed and the water in conduit 20 will pull water from the source, which will purge any air from the system. After the water runs continuously from flow outlet 24 the system has been fully purged of air. System flow valve 28 is then closed and the system is ready for operation. At that point air inlet valve 38*b* is opened to allow the admission of air into holding canister 16, and outlet valve 40 is then opened and left in the open position, which allows water to flow out of holding canister 16, through check valve 42, and into destination container 34. As holding canister 16 empties, air inlet valve 38*b* is closed to prevent the admission of air into the system. As water is needed, system flow control valve 28 is opened to allow water to flow through siphon conduits 14 and 20. Check valve 42 will close and work automatically with trapped water in outlet conduit 32. As water flows through the system it replaces water that has been withdrawn from holding canister 16. System flow control valve 28 and air inlet valve 38*b* when in the closed position leave the system full of water and ready for further withdrawals of water as needed.

Figure 2:
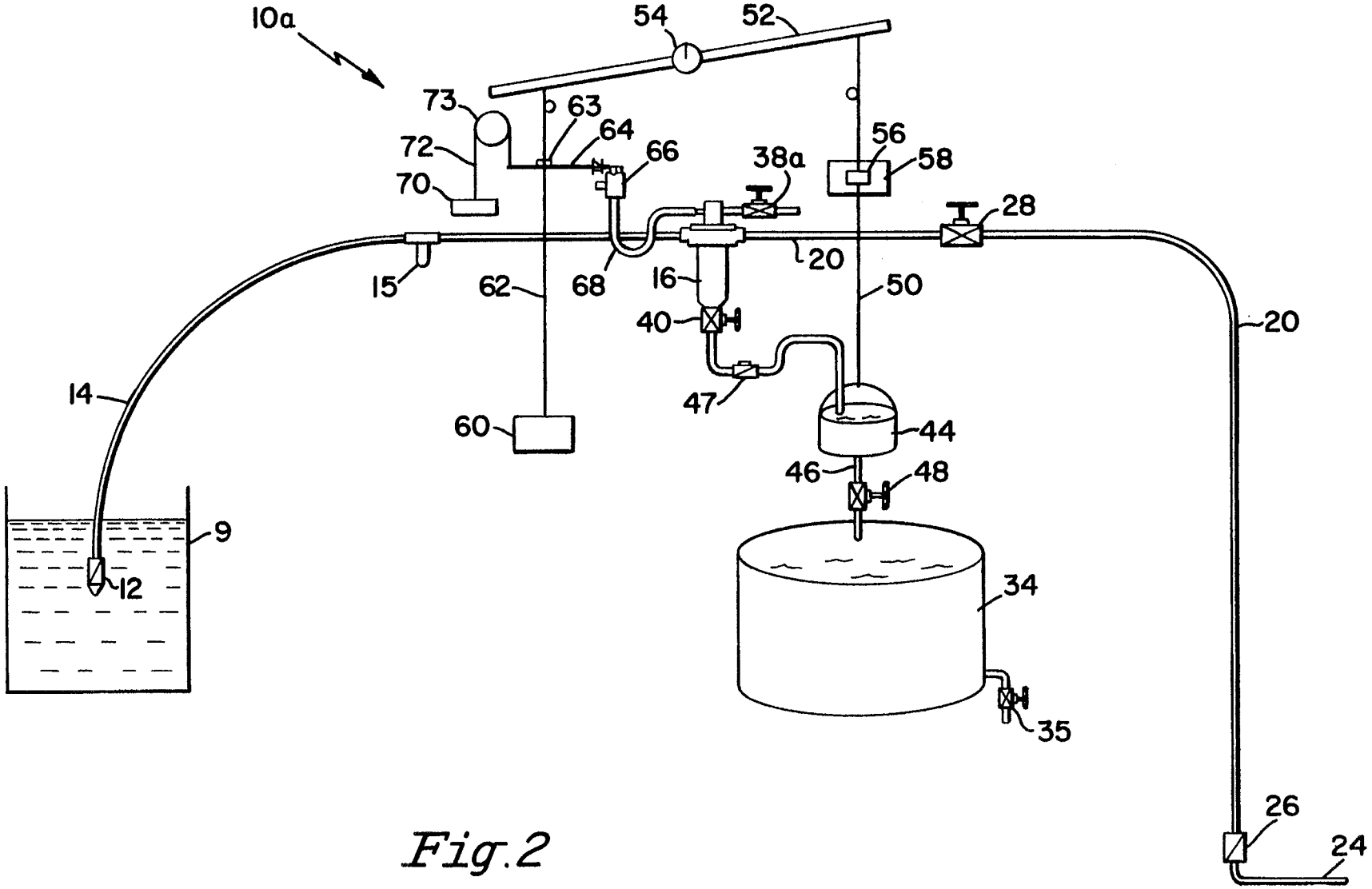
FIG. 2 is a schematic view similar to that of FIG. 1, showing an alternate embodiment incorporating an automatic, mechanically controlled siphon pump system.

The system 10*a* shown in FIG. 2 is generally similar to the system 10 shown in FIG. 1 except that system 10*a* includes apparatus to automatically restore the system to the ready condition after water has been dispensed, by automatically refilling holding canister 16. Referring now to FIG. 2, in which parts corresponding with those shown in FIG. 1 are identified by the same reference numerals, the system elements include those identified in the embodiment shown in FIG. 1, together with additional elements to provide automatic operation. Positioned between holding canister 16 and destination container 34 is an upper timing bucket 44 that is positioned below the outlet from holding canister 16. Timing bucket 44 is suitably supported for movement in a vertical direction, and it includes an outlet conduit 46 in which an outlet flow control valve 48 is provided. Bucket 44 is supported from a cable 50 that extends from the bail of bucket 44 upwardly to a balance arm 52 that is supported for pivotal movement about a pivot axis 54. Cable 50 carries a control magnet 56 that selectively engages with a magnetic plate 58 for holding timing bucket 44 in a upper position (as illustrated in FIG. 2) when the bucket is empty.

At the opposite end of balance arm 52 from support cable 50 for timing bucket 44 is a balance arm counterweight 60 that is suspended from a counterweight cable 62 that is connected with balance arm 52 on the opposite side of pivot axis 54 from cable 50. Cable 62 passes through an aperture in a control arm 64 that extends outwardly from an air admitting valve 66 that is in communication with the upper portion of holding canister 16 through valve conduit 68. A control member 63, such as a cable clamp member, or the like, to provide an enlarged area on cable 62 is carried by counterweight cable 62 for contacting control arm 64 as cable 62 moves downwardly, through the aperture in control arm 64, for urging control arm 64 downwardly to maintain valve 66 in the open position. The outermost end of control arm 64 is urged into an upper position, to close valve 66, by a valve counterweight 70 that is carried by a control arm cable 72 that passes around a pulley 73 to maintain valve 66 in the closed position.

Figure 3:
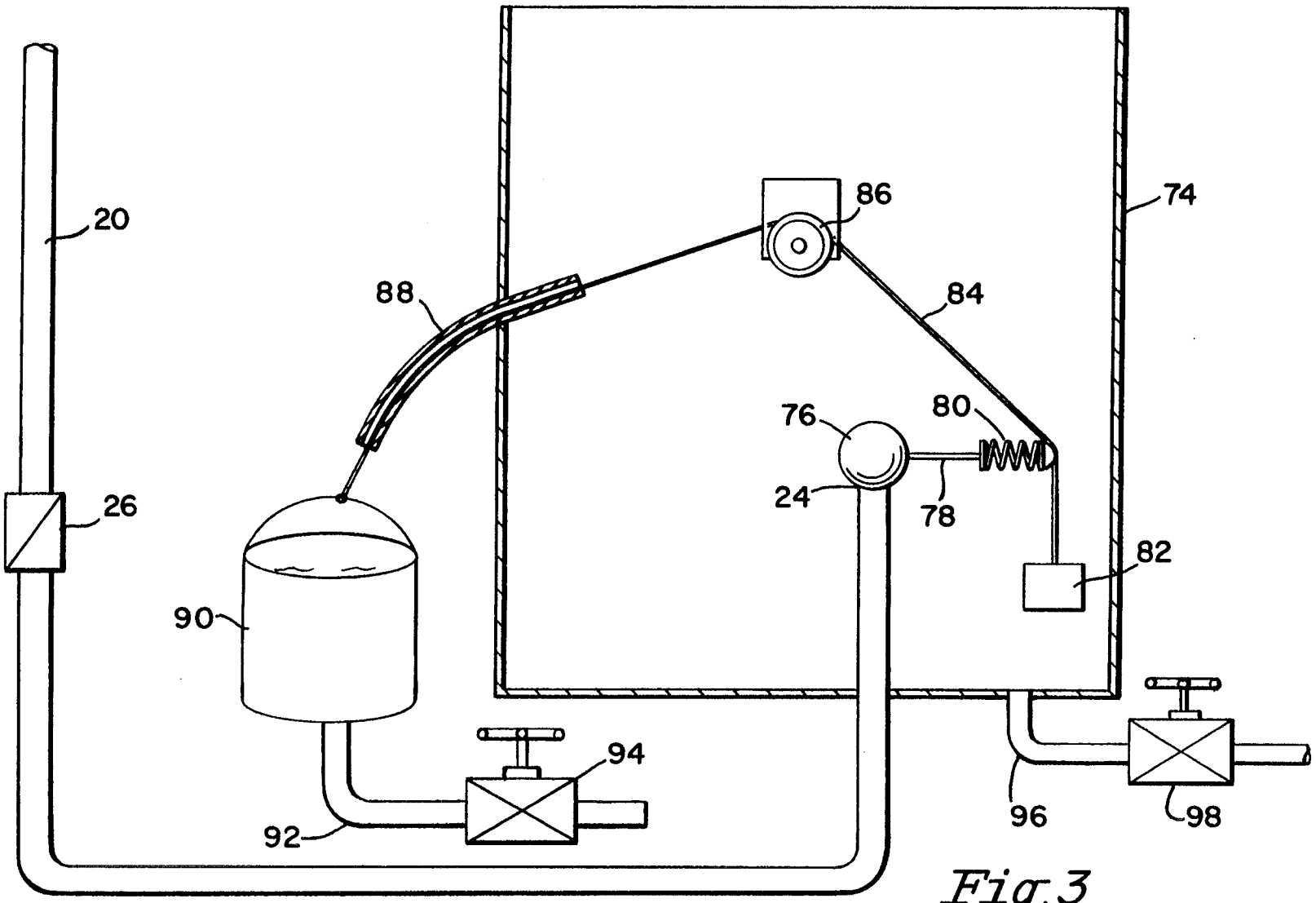
FIG. 3 is an enlarged fragmentary view of a lower flow control chamber forming part of the siphon pump system shown in FIG. 2.

At the downstream or outlet end 24 of second siphon conduit 20 is a lower control chamber 74 that is shown in FIG. 3. Outlet end 24 of second siphon conduit 20 extends upwardly through the bottom and into the interior of lower control chamber 74 and terminates at a point between the upper and lower surfaces of the chamber at a float valve 76. A float valve arm 78 extends from float valve 76 and carries a strong spring 80 at its end. A counterweight 82 is positioned at the outer end of spring 80 to pull downwardly on float valve arm 78 and thereby hold float valve 76 in an open position. A control cable 84 is connected with and extends from spring 80 in an upward direction within lower control chamber 74 to pass over a pulley 86 and then pass downwardly and outwardly through the side wall of lower control chamber 74 through a combined cable guide and water outlet tube 88. Positioned below the outlet of outlet tube 88 is a second timing bucket 90 having a bail to which control cable 84 is connected. Second timing bucket 90 is suitably supported for vertical movement, and it includes an outlet conduit 92 that carries an adjustable outflow valve 94 to control the rate of flow of water from second timing bucket 90.

Lower control chamber 74 also includes an outlet conduit 96 that carries an adjustable flow control valve 98 to regulate the rate of flow of water from the lower control chamber for discharge from the system.

In operation, system 10*a* shown in FIGS. 2 and 3 is initially primed in substantially the same way as that of system 10 shown in FIG. 1. Because of the effect of counterweight 82 on float valve 76 when no water is present second timing bucket 90, water flows from second siphon conduit 20 into lower control chamber 74 until it reaches a level that enables it to flow outwardly through cable guide and outlet tube 88 and into second timing bucket 90. The rate of outflow through timing bucket flow control valve 94 is adjusted to a desired amount, as is the outflow through outlet flow control valve 98 for lower control chamber 74. As second timing bucket 90 becomes heavier as a consequence of its being filled with water, it pulls control cable 84 that is connected with float valve arm 78, ultimately lifting the arm to cause float valve 76 to close. In the meantime, water flowing from lower control chamber 74 through flow control valve 98 Causes the level of water within lower control chamber 74 to gradually diminish until water no longer flows into second timing bucket 90. Consequently, because of the setting of outlet flow control valve 94, timing bucket 90 gradually empties, thereby causing counterweight 82 within lower control chamber 74 to pull on cable 84 to lift timing bucket 90 upwardly, and simultaneously to cause float valve arm 78 to move downwardly and thereby open float valve 76 to once again permit water to flow into lower control chamber 74. Thus, the time during which float valve 76 is in the closed position is dependent upon the flow rate through timing bucket outlet flow control valve 94.

When the flow of water through the second siphon conduit 20 is stopped by the closing of the float valve 76 in the lower control chamber 74, air is admitted into the upper portion of the holding canister 16. The air enters the holding canister 16 through the air admitting valve 66 to permit the holding canister 16 to empty its contents into the upper timing bucket 44. When the upper timing bucket 44 is empty, counterweight 60 pulls the air admitting valve 66 open, allowing air to enter the holding canister 16. When the upper timing bucket 44 contains water, it is at a lower position, relative to the remaining structure, from the position in which it is shown in FIG. 2. The weight of the water serves to pull bucket 44 downwardly, and with it cable 50, to release control magnet 56 from plate 58, and to cause balance arm 52 to pivot in a clockwise direction (as viewed in FIG. 2) about pivot axis 54. As a result, cable 62 is lifted upwardly by balance arm 52, releasing control member 63 from its former position in which it operated to hold down control arm 64, thereby permitting counterweight 70 to pull control arm 64 upwardly to close valve 66 to prevent the entry of air into the system through valve conduit 68 and the air admitting valve 66. Thus, when the upper timing bucket 44 is empty, the downward force of control member 63 on control arm 64 permits the automatic entry of air into the system through valve 66 and conduit 68, and the subsequent positioning of the charging valve 38*a* in a closed position, relative to air admitting valve 66, serves to prevent the introduction of air into the system.

The embodiment of the invention illustrated in FIGS. 2 and 3 therefore provides distinct advantages over the known siphon systems in that it permits automatic operation without the need for connection of any of the components with a source of outside electrical power.

Figure 4:
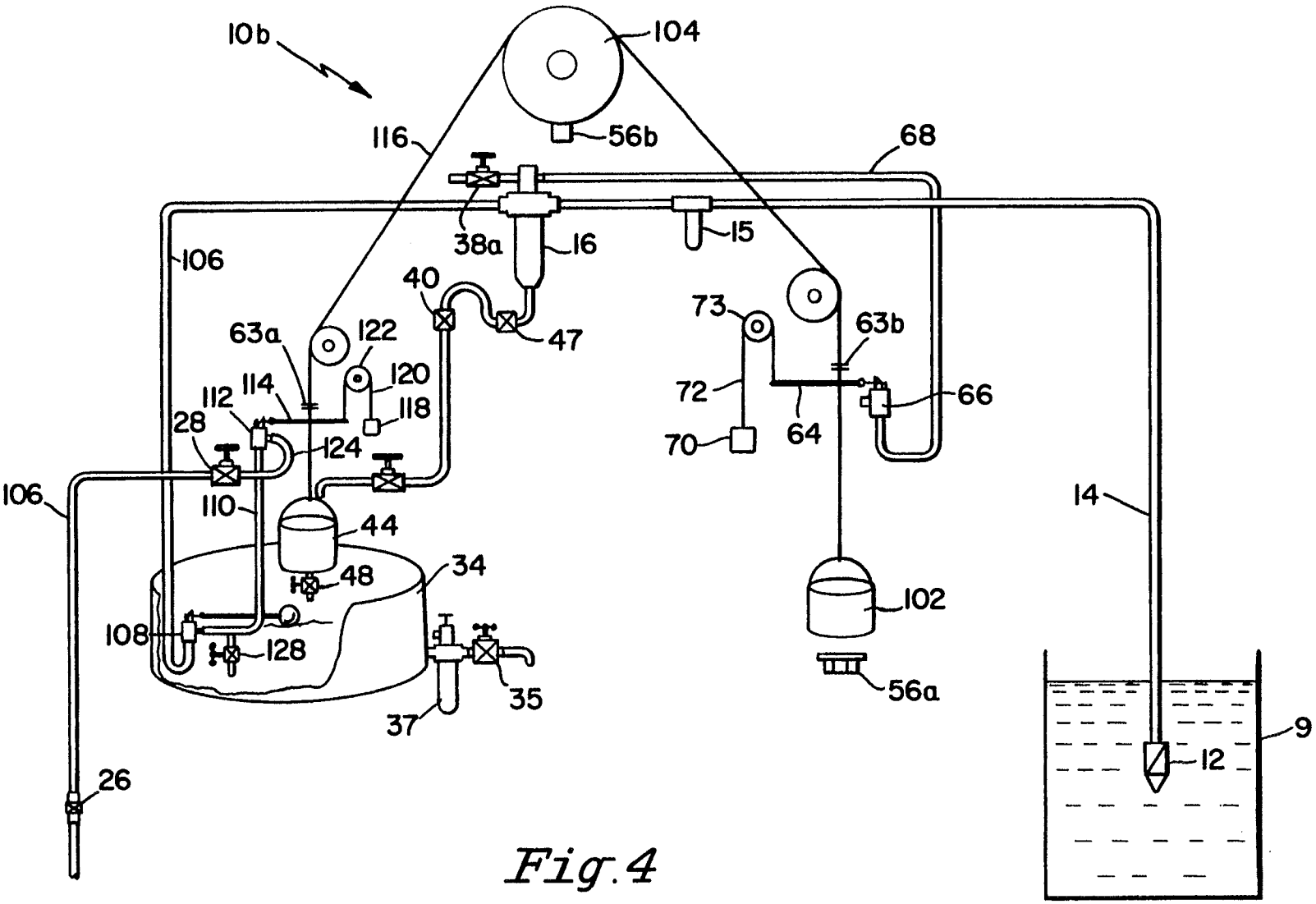
FIG. 4 is a schematic view of an additional embodiment of an automatic, siphon-pump-based, water supply system.

Another embodiment of the invention that operates automatically is shown in FIG. 4. Again, parts for system 10*b* as shown in FIG. 4 that are common with parts forming part of system 10*a* shown in FIG. 2 have the same reference numerals. The principal differences in the FIG. 4 arrangement as compared with the arrangement shown in FIG. 2 and 3 reside in the automatic features. A metal bucket 102 replaces counterweight 60 of FIG. 2, and pulley 104 replaces balance arm 52 of FIG. 2. Additionally, instead of the separate lower control chamber 74 and associated control elements of FIG. 3, the FIG. 4 embodiment incorporates the control apparatus above and within destination container 34. In that regard, second siphon conduit 106 terminates within destination container 34 at a float operated flow control valve 108, in which the float responds to the water level within destination container 34 to control flow from conduit 106 to conduit 110 and then to flow control valve 112. A control arm 114 on valve 112 is operated by movement of cable 116, which is, in turn, actuated by timing bucket 44, which is connected by cable 116 with bucket 102. The free end of control arm 114 is connected with counterweight 118 through cable 120, which passes over pulley 122. The outlet from valve 112 is connected with a conduit 124 that is in communication with second siphon conduit 106 and that includes main system flow control valve 28. Destination container 34 can include an additional filter element 37 at the outlet, if desired.

The operation of the system shown in FIG. 4 is similar to that of FIGS. 2 and 3. Flow is controlled by the settings of the several automatically operated flow control valves, such as valves 112 and 66, the positions and settings of which are dependent upon the weight of water that is contained in timing bucket 44 and that in metal bucket 102. Additionally, the setting of valve 48 at the bottom of timing bucket 44, and the gradual opening and reclosing of setting valve 128 in conduit 110 also have an effect on overall flow and on the timing of the system.

Although particular embodiments of the present invention have been illustrated and described, it will be apparent to those skilled in the art that various changes and modifications can be made without departing from the spirit of the present invention. Accordingly, it is intended to encompass within the appended claims all such changes and modifications that fall within the scope of the present invention.

What is claimed is:

1. A siphon pump system for dispensing a predetermined quantity of water from a water supply source, said pump system comprising:

a. a destination container for receiving water from the water supply source;

b. a holding canister including an air inlet valve for allowing air to enter the system and an outlet check valve for controlling the rate of flow of water from the holding canister into the destination container;

c. a first siphon conduit extending from the water supply source to the holding canister, the first siphon conduit having an inlet within the water supply source and an outlet connected with the holding canister and positioned at an elevation above that of the water supply source;

d. a second siphon conduit extending from the holding canister to an outlet at an elevation below the level of the water supply source, the second siphon conduit having a longer length than that of the first siphon conduit;

e. a system flow control valve positioned in the second siphon conduit for controlling the flow of water through the first siphon conduit, the holding canister, and the second siphon conduit;

f. an anti-backflow valve positioned within and adjacent the outlet of the second siphon conduit, for preventing reverse flow of air into the second siphon conduit from the second siphon conduit outlet;

g. a flow control valve in the second siphon conduit upstream of the anti-backflow valve for controlling flow of water through the first siphon conduit, the holding canister, and the second siphon conduit; and h. a charging inlet at an upper end of the holding canister for initially priming the siphon pump system; and i. an air admitting valve communicating with an upper end of the holding canister for selectively admitting air into the holding canister to permit water to exit from the holding canister when the air admitting valve is open, and for preventing water from exiting from the holding canister and through the anti-backflow valve when the air admitting valve is closed.

2. A siphon pump system in accordance with claim 1 including an anti-backflow valve positioned in the first siphon conduit for preventing backflow of water within the first siphon conduit from the holding canister to the water supply source.

3. A siphon pump system in accordance with claim 1 including an anti-backflow valve positioned between the outlet of the holding canister and an outlet to the destination container.

4. A siphon pump system in accordance with claim 3 including a lower control chamber positioned adjacent the outlet from the second siphon conduit, and a float valve within the lower control chamber for controlling the water flow in the first and second siphon conduits.

5. A siphon pump system in accordance with claim 4, wherein the air admitting valve includes a control arm to open and close the air admitting valve, wherein the control arm is operatively Connected with a first timing bucket that is positioned to receive water from the holding canister to cause the first timing bucket to move from a first, upper position at a time when the timing bucket is empty and the air admitting valve is opened to permit water to flow from the holding canister into the first timing bucket, to a second, lower position after the first timing bucket receives water from the holding canister and moves downwardly to cause the air admitting valve to close after the first timing bucket has received the water that was contained within the holding canister.

6. A siphon pump system in accordance with claim 5 wherein the lower control chamber includes a float valve operatively connected with a second timing bucket for receiving overflow water from the lower control chamber, the float valve having an arm connected by a cable with the second timing bucket to permit the position of the second timing bucket to control the position of the float valve arm.

7. A siphon pump in accordance with claim 6 wherein the second timing bucket includes an adjustable outlet flow control valve.

8. A siphon pump system in accordance with claim 6 wherein the lower control chamber includes an outlet having a flow control valve.

9. A siphon pump in accordance with claim 7 wherein the second timing bucket outlet flow control valve and the lower control chamber outlet flow control valve are set to operate the lower control chamber float control valve in timed relationship with the operation of the first timing bucket.

10. A siphon pump in accordance with claim 3 including mechanical timing means for time coordinating siphon flow and air admitting valve opening and closing, including an air admitting valve counterweight connected with a first timing bucket, wherein the first timing bucket receives water from the holding canister to control operation of the air admitting valve.

11. A siphon pump in accordance with claim 5 including a balance arm for supporting the first timing bucket from one end of the balance arm and a control cable extending from an opposite end of the balance arm, the control cable including a control member engageable with the air admitting valve control arm, and a control magnet positioned between and connected with the balance arm and the first timing bucket, a magnetically permeable fixed plate engageable with the control magnet for supporting the first timing bucket in the first, upper position until the first timing bucket receives sufficient water from the holding canister to attain a weight sufficient to separate the control magnet from the fixed plate and cause the first timing bucket to move downwardly and cause the balance arm to pivot and to move the control member carried by the control cable away from the air admitting valve control arm to close the air admitting valve.

12. A siphon pump in accordance with claim 1 including timing apparatus for automatically periodically admitting air into the holding canister for releasing water contained in the holding canister, the timing apparatus including an air inlet valve in communication with the holding canister for selectively admitting air into the holding canister, air inlet valve actuation means including a pivotable balance arm having a first end supporting a timing bucket to receive water from the holding canister, and a second end spaced from the first end on an opposite side of a pivot positioned between the first and second ends of the balance arm, and a cable extending from the second end of the balance arm and supporting a counterweight having a predetermined weight, the cable including a cable clamp member engageable with a control arm connected with and operative to control opening and closing of the air inlet valve, wherein the air inlet valve is open when the timing bucket is empty of water and the air inlet valve is closed when the timing bucket contains sufficient water to exceed the weight of the counterweight, and wherein the timing bucket includes an outlet flow control valve to permit flow of water from the timing bucket into the destination container at a predetermined flow rate.

13. A siphon pump in accordance with claim 1 including timing apparatus for automatically periodically controlling system siphon flow and for admitting air into the holding canister for releasing water contained in the holding canister, the timing apparatus including air admitting valve actuation means including a pulley member and a cable passing over the pulley member and having a first end engageable with and supporting a timing bucket to receive water from the holding canister, and a second end supporting a counterweight having a predetermined weight, the cable including a first cable clamp member engageable with a control arm connected with and operative to control opening and closing of the system flow control valve, wherein the system flow control valve is closed when the timing bucket is empty of water and the system flow control valve is open when the timing bucket contains sufficient water to exceed the weight of the counterweight, the cable including a second cable clamp member engage able with a control arm connected with and operative to control opening and closing of the air admitting valve, wherein the air admitting valve is open when the timing bucket is empty of water and the air admitting valve is closed when the timing bucket contains sufficient water to exceed the weight of the counterweight, and wherein the timing bucket includes an outlet flow control valve to permit flow of water from the timing bucket into the destination container at a predetermined flow rate.

* * * * *